US007173592B2

(12) United States Patent
Yamashita et al.

(10) Patent No.: US 7,173,592 B2
(45) Date of Patent: Feb. 6, 2007

(54) DISPLAY DEVICE AND ITS DRIVING METHOD, AND PROJECTION-TYPE DISPLAY DEVICE

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 593 days.

(21) Appl. No.: 10/450,347

(22) PCT Filed: Oct. 10, 2002

(86) PCT No.: PCT/JP02/10554

§ 371 (c)(1),
(2), (4) Date: Jun. 12, 2003

(87) PCT Pub. No.: WO03/034393

PCT Pub. Date: Apr. 24, 2003

(65) Prior Publication Data

US 2004/0041772 A1 Mar. 4, 2004

(30) Foreign Application Priority Data

Oct. 17, 2001 (JP) ..... 2001-319262

(51) Int. Cl.
*G09G 3/36* (2006.01)

(52) U.S. Cl. ..... 345/98

(58) Field of Classification Search ..... 345/87–104
See application file for complete search history.

(56) References Cited

U.S. PATENT DOCUMENTS 6,020,872 A * 2/2000 Mizukata et al. ..... 345/99
6,229,513 B1 * 5/2001 Nakano et al. ..... 345/99
6,320,566 B1 * 11/2001 Go ..... 345/99
6,466,192 B2 * 10/2002 Imamura ..... 345/98
6,529,181 B2 * 3/2003 Nakano et al. ..... 345/98

(Continued)

FOREIGN PATENT DOCUMENTS

JP 11-065536 3/1999

(Continued)

*Primary Examiner*—Sumati Lefkowitz
*Assistant Examiner*—Srilakshmi K Kumar
(74) *Attorney, Agent, or Firm*—Robert J. Depke; Rockey, Depke, Lyons & Kitzinger LLC

(57) ABSTRACT

An object of the present invention is to suppress a picture defect such as a vertical streak, a ghost or the like on an active matrix display apparatus of a divided sample and hold type.

A horizontal driving circuit (17) sequentially generates sampling pulses of which sampling pulses supplied to sampling switches (23) connected to an identical video line (25) do not overlap each other and sampling pulses supplied to adjacent sampling switches (23) overlap each other, and drives the switches, whereby a video signal is sequentially written to pixels (11). A clock generating circuit (18) generates a clock signal HCK serving as a basis for operation of the horizontal driving circuit (17), and a clock signal 2HCK having twice a cycle of the clock signal HCK and twice a pulse width of the clock signal HCK. The horizontal driving circuit (17) includes: a shift register (21) for performing shift operation in synchronism with the clock signal HCK and sequentially outputting shift pulses; and an extracting switch group (22) for extracting the clock signal 2HCK in response to the shift pulses, and sequentially generating the sampling pulses.

3 Claims, 9 Drawing Sheets

U.S. PATENT DOCUMENTS

| | | | | |
|---|---|---|---|---|
| 6,611,248 | B2 * | 8/2003 | Kanbara et al. | 345/100 |
| 6,744,417 | B2 * | 6/2004 | Yamashita et al. | 345/92 |
| 6,909,417 | B2 * | 6/2005 | Washio et al. | 345/98 |
| 6,999,055 | B2 * | 2/2006 | Yamashita et al. | 345/98 |

FOREIGN PATENT DOCUMENTS

| | | |
|---|---|---|
| JP | 2000-267616 | 9/2000 |
| WO | WO 01/97205 | 12/2001 |

* cited by examiner

DISPLAY DEVICE AND ITS DRIVING METHOD, AND PROJECTION-TYPE DISPLAY DEVICE

TECHNICAL FIELD

The present invention relates to a display apparatus, and particularly to a dot-sequential driving type active matrix display apparatus in which a clock driving system is applied to a horizontal driving circuit of a divided sample and hold system.

BACKGROUND ART

An active matrix display apparatus comprises a panel having gate lines in a form of rows, signal lines in a form of columns, and pixels arranged in a form of a matrix at intersections of the gate lines and the signal lines. A thin film transistor (TFT), for example, is formed as an active element in each of the pixels. The display apparatus further includes a vertical driving circuit and a horizontal driving circuit. The vertical driving circuit is connected to each of the gate lines, and sequentially selects rows of the pixels. The horizontal driving circuit is connected to each of the signal lines, and sequentially writes a video signal to pixels of a selected row. At this time, the horizontal driving circuit in a dot-sequential driving system writes the video signal to the pixels of the selected row on a dot-sequential basis.

In the active matrix display apparatus, there is parasitic capacitance between source/drain electrodes of TFTs and signal lines. This parasitic capacitance may cause a potential change at the time of writing the video signal through a certain signal line to jump into an adjacent signal line, resulting in a picture defect such as a vertical streak or the like. This vertical streak defect is conspicuous especially when a checkered pattern is displayed in a line reversal driving system. Alternatively, a vertical streak tends to occur when a horizontal line having a thickness of one dot (one pixel) is displayed in a dot line reversal driving system.

In order to prevent the jump of the video signal between the signal lines, so-called divided sample and hold driving has been proposed, which is disclosed in Japanese Patent Laid-Open No. 2000-267616, for example. The divided sample and hold system separates an input video signal into two systems, and writes the video signal on a dot-sequential basis while overlapping the video signals in the two systems for pixels adjacent to each other.

FIG. 7 is a schematic diagram showing an example of a display apparatus using the above-mentioned divided sample and hold driving. As shown in FIG. 7, the display apparatus comprises a panel including gate lines 113 in a form of rows, signal lines 112 in a form of columns, pixels 111 arranged in a form of a matrix at intersections of the gate lines 113 and the signal lines 112, and two video lines 125 and 126 for supplying video signals Video 1 and Video 2 separated in two systems in predetermined phase relation. A sampling switch group 123 is disposed so as to correspond to each of the signal lines 112, and is connected between each of the two video lines and the signal lines with two signal lines as a unit. Specifically, a first signal line is connected to one video line 125 via a sampling switch, and a second signal line is similarly connected to the other video line 126 via a sampling switch. Thereafter, a third and succeeding signal lines are alternately connected to the two video lines 125 and 126 via sampling switches. Also formed on the panel are a vertical driving circuit 116 and a horizontal driving circuit 117. The vertical driving circuit 116 is connected to each of the gate lines 113 to sequentially select rows of the pixels 111. In other words, the pixels 111 arranged in the form of a matrix are sequentially selected in units of a row. The horizontal driving circuit 117 operates on the basis of a clock signal having a predetermined cycle. The horizontal driving circuit 117 sequentially generates sampling pulses A, B, C, D, . . . of which pulses supplied to switches connected to the same video line among the switches of the sampling switch group 123 do not overlap each other and pulses supplied to adjacent switches overlap each other, and then sequentially drives the switches for opening and closing thereof. The video signals are thereby written to pixels 111 of a selected row on the dot-sequential basis. The display apparatus further includes a clock generating circuit 189. The clock generating circuit 189 supplies a start pulse HST as well as a clock signal HCK serving as a basis for operation of the horizontal driving circuit 117. The horizontal driving circuit 117 comprises a multistage-connected shift register (S/R) 121. The shift register 121 sequentially transfers the start pulse HST in response to the clock signal HCK and thereby sequentially generates the above-mentioned sampling pulses A, B, C, D . . . .

Operation of the conventional display apparatus shown in FIG. 7 will be briefly described with reference to a waveform chart of FIG. 8. As described above, the horizontal driving circuit operates in response to the clock signal HCK, and generates the sampling pulses A, B, C, D . . . by sequentially transferring the start pulse HST. As is clear from FIG. 8, sampling pulses between adjacent signal lines overlap each other. Specifically, the sampling pulse A corresponding to the first signal line overlaps the sampling pulse B corresponding to the second signal line. Similarly, the sampling pulse B corresponding to the second signal line overlaps the sampling pulse C corresponding to the third signal line. Since the signal lines adjacent to each other are supplied with the video signals from the separate video lines, the overlap does not present a problem. The sampling pulses supplied to the sampling switches of the signal lines adjacent to each other are generated so as to overlap each other, whereby a conventional problem of a vertical streak defect can be prevented. Specifically, even when there is parasitic capacitance between the source/drain electrodes of the pixel transistors and the signal lines and a potential change in a certain signal line jumps into an adjacent signal line via the parasitic capacitance, the signal line is at low impedance because of overlap sampling, and is therefore not affected by the jump of the video signal.

In the example shown in FIG. 8, a signal potential Sig1 is sampled and held in the corresponding first signal line in response to the sampling pulse A. Then, a signal potential Sig2 is sampled and held in the second signal line in response to the sampling pulse B. At this time, a potential change occurs in the second signal line. This potential change also jumps into the first signal line via the parasitic capacitance. At this time, since the sampling switch corresponding to the first signal line is still opened, the first signal line is at a low impedance and is therefore not affected by the signal jump.

FIG. 9 schematically shows timing of the sampling of the video signals for the signal lines and change in potential of the video lines. Basically, sampling pulses supplied to the sampling switches connected to the same video line are generated so as not to overlap each other. For example, the first signal line and the third signal line are connected to the same video line. Circuit design is thus made such that the sampling pulse A and the sampling pulse C do not overlap each other in principle. In practice, however, a delay is caused by wiring resistance, parasitic capacitance and the like, and waveforms of the sampling pulse A and the sampling pulse C are rounded in a pulse transmission process. As a result, the sampling pulse A and the sampling pulse C partially overlap each other. In such a state, when the sampling pulse C rises, the corresponding sampling switch is opened, and charge/discharge occurs in the signal line, thus resulting in a potential swing in the video signal Video 1 on the video line, as indicated by a solid arrow. At this time, because the preceding sampling pulse A has not completely fallen yet, the potential swing (charge/discharge noise) on the video line is picked up, as indicated by a dotted arrow. This results in variation in the potential sampled and supplied to the signal line, and hence a vertical streak on the screen, which degrades picture quality. Further, such an interference of the video signal between signal lines connected to the same video line may cause a ghost or the like on the screen.

DISCLOSURE OF INVENTION

In view of the above problems of the related art, it is an object of the present invention to suppress an interference of a video signal between signal lines connected to the same video line in an active matrix display apparatus using the so-called divided sample and hold system and thus suppress a picture defect such as a vertical streak, a ghost or the like. The following means are provided to achieve the object. According to the present invention, there is provided a display apparatus characterized by including: a panel including gate lines in a form of rows, signal lines in a form of columns, pixels arranged in a form of a matrix at intersections of the gate lines and the signal lines, and n (n is an integer of 2 or more) video lines for supplying video signals separated in n systems in predetermined phase relation; a vertical driving circuit connected to each of the gate lines for sequentially selecting rows of the pixels; a sampling switch group disposed so as to correspond to each of the signal lines, and connected between each of the n video lines and the signal lines with n signal lines as a unit; a horizontal driving circuit operating on the basis of a clock signal having a predetermined cycle, for sequentially generating sampling pulses of which sampling pulses supplied to switches connected to an identical video line among switches of the sampling switch group do not overlap each other and sampling pulses supplied to adjacent switches overlap each other, and sequentially driving the switches, whereby the video signals are sequentially written to pixels of a selected row; and a clock generating circuit for generating a first clock signal serving as a basis for operation of the horizontal driving circuit, and also generating a second clock signal having twice a cycle of the first clock signal and twice a pulse width of the first clock signal; wherein the horizontal driving circuit includes: a shift register for performing shift operation in synchronism with the first clock signal and sequentially outputting shift pulses from respective shift stages; and an extracting switch group for extracting the second clock signal in response to the shift pulses sequentially outputted from the shift register, and sequentially generating the sampling pulses. Preferably, the clock generating circuit can variably adjust a phase of the second clock signal with respect to the first clock signal. More specifically, the clock generating circuit variably adjusts the phase of the second clock signal with respect to the first clock signal, and thus optimizes a width of the sampling pulses.

According to the present invention, in the display apparatus using divided sample and hold driving, the shift pulses outputted from the horizontal driving circuit are extracted by another clock signal, and thereby the sampling pulses are generated. By introducing such a clock driving system, overlap of sampling pulses between adjacent signal lines is maintained, while perfect non-overlap of sampling pulses between alternate signal lines connected to the same video line is realized. In particular, according to the present invention, the phase of the second clock signal can be variably adjusted with respect to the first clock signal. It is thereby possible to optimize the width of the sampling pulses to deal with a display defect such as a vertical streak, a ghost or the like.

BEST MODE FOR CARRYING OUT THE INVENTION

Figure 1:
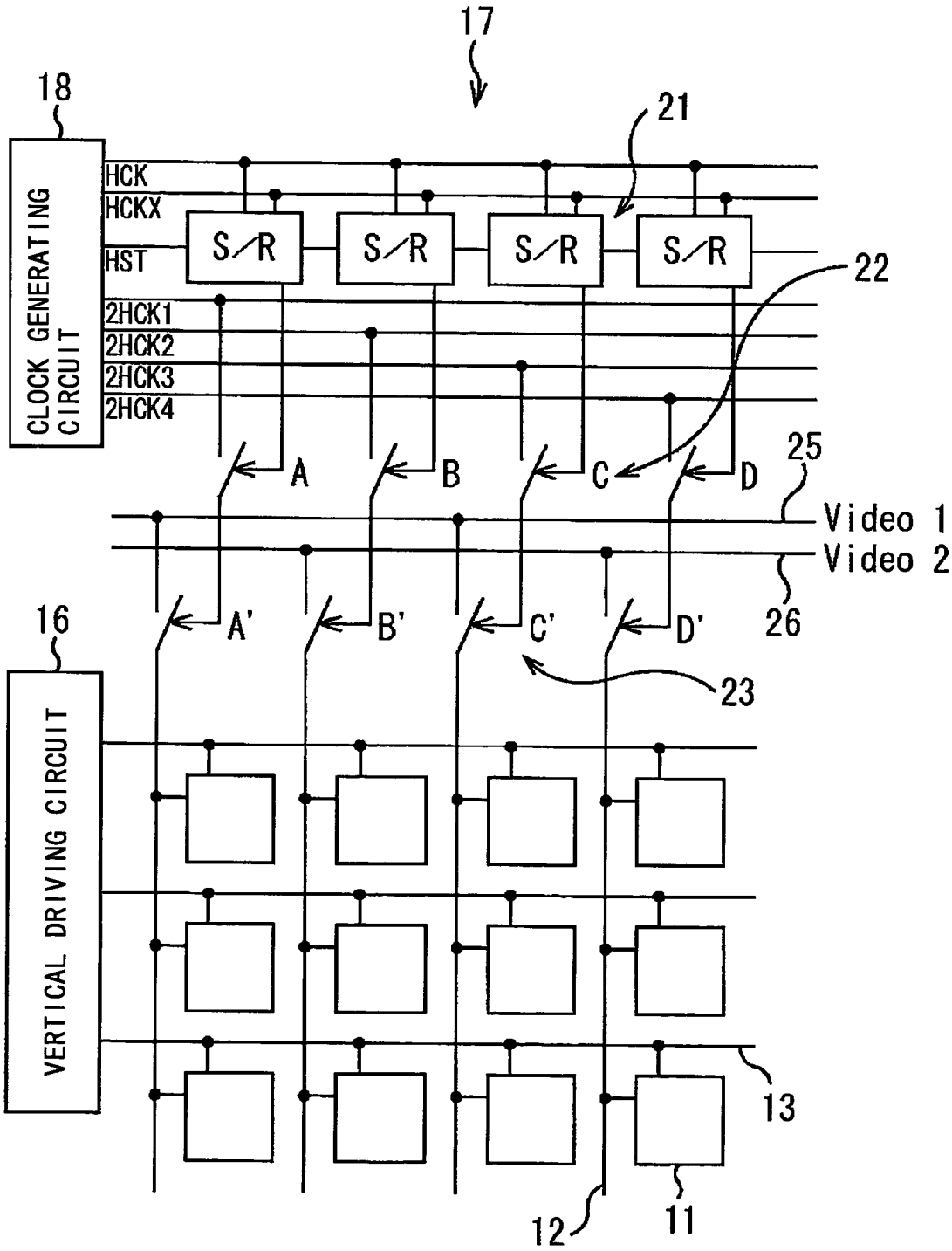
FIG. 1 is a block diagram showing a basic configuration of a display apparatus according to the present invention.

A preferred embodiment of the present invention will hereinafter be described in detail with reference to the drawings. FIG. 1 is a schematic block diagram showing a basic configuration of a display apparatus according to the present invention. The display apparatus comprises a panel including gate lines 13 in a form of rows, signal lines 12 in a form of columns, pixels 11 arranged in a form of a matrix at intersections of the gate lines 13 and the signal lines 12, and two video lines 25 and 26 for supplying video signals Video 1 and Video 2 separated in two systems in predetermined phase relation. It is to be noted that while a video signal is divided into two systems in this example, the present invention is not limited to this; the video signal can generally be divided into n systems, where n is an integer of 2 or more. In this case, the video signals separated in the n systems are supplied separately through n video lines.

Also formed on the panel are a vertical driving circuit 16, a horizontal driving circuit 17, a sampling switch group 23 and the like. The vertical driving circuit 16 is connected to each of the gate lines 13 to sequentially select the pixels 11 in units of a row. The sampling switch group 23 is disposed so as to correspond to each of the signal lines 12, and comprises individual switches connected between each of the two video lines 25 and 26 and the signal lines 12 with two signal lines as a unit. For example, a switch provided for a first signal line is connected to one video line 25, and a switch provided for a second signal line is connected to the other video line 26. Thus, the switches of the sampling switch group 23 alternately connect the signal lines 12 to the two video lines 25 and 26. However, the present invention is not limited to this; the sampling switch group 23 is generally connected between each of n video lines and signal lines with n signal lines as a unit. The horizontal driving circuit 17 operates on the basis of clock signals having predetermined cycles. The horizontal driving circuit 17 sequentially generates sampling pulses A', B', C', D', . . . of which pulses supplied to switches connected to the same video line among the switches of the sampling switch group 23 do not overlap each other and pulses supplied to adjacent switches overlap each other, and then sequentially drives the switches for opening and closing thereof. A video signal is thereby sequentially written to pixels of a selected row. For example, the sampling pulses A' and C' that do not overlap each other are supplied to the first and third switches connected to the same video line 25. On the other hand, the sampling pulses A' and B' that overlap each other are sequentially generated for the first and second switches adjacent to each other. The switches adjacent to each other are connected to the separate video lines 25 and 26.

As a feature of the present invention, a clock generating circuit 18 is provided. The clock generating circuit 18 generates first clock signals HCK and HCKX serving as a basis for operation of the horizontal driving circuit 17, and also generates second clock signals 2HCK1, 2HCK2, 2HCK3, and 2HCK4 having twice a cycle of the first clock signals HCK and HCKX and having twice a pulse width of the first clock signals HCK and HCKX. The first clock signals HCK and HCKX are of opposite polarity from each other. In the present specification, the first clock signals HCK and HCKX may be collectively referred to as an HCK pulse. On the other hand, the second clock signals 2HCK1, 2HCK2, 2HCK3, and 2HCK4 are shifted in phase with respect to each other by 90 degrees. In the present specification, these second clock signals may be collectively referred to as a 2HCK pulse. On the other hand, the horizontal driving circuit 17 comprises a shift register 21 and an extracting switch group 22. The shift register 21 performs shift operation in synchronism with the first clock signals HCK and HCKX, and thereby sequentially outputs shift pulses A, B, C, D . . . from respective shift stages S/R. The extracting switch group 22 extracts the second clock signals 2HCK1, 2HCK2, 2HCK3, and 2HCK4 in response to the shift pulses A, B, C, D . . . sequentially outputted from the shift register 21, and thereby sequentially generates the above-mentioned sampling pulses A', B', C', D' . . . . Specifically, an extracting switch corresponding to a first stage of the shift register 21 extracts the second clock signal 2HCK1 in response to the shift pulse A, and thereby generates the sampling pulse A'. Similarly, an extracting switch corresponding to a second stage of the shift register 21 extracts the second clock signal 2HCK2 in response to the shift pulse B, and thereby generates the sampling pulse B'. The clock generating circuit 18 can variably adjust the phase of the second clock signals 2HCK1, 2HCK2, 2HCK3, and 2HCK4 with respect to the first clock signals HCK and HCKX. It is thereby possible to optimize the pulse width of the sampling pulses A', B', C', D' . . . and thus cope with display defects such as a vertical streak and a ghost.

Figure 2:
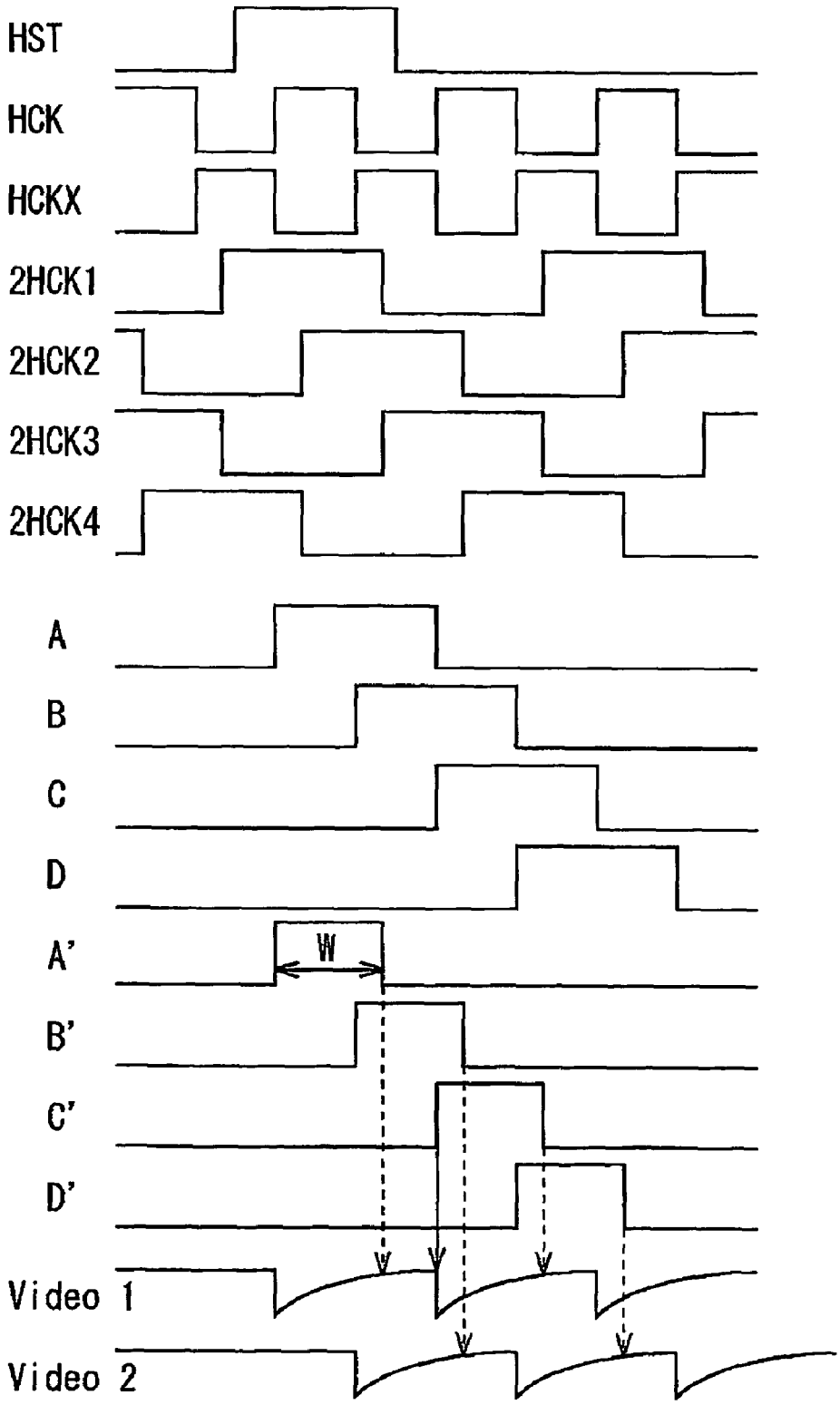
FIG. 2 is a waveform chart of assistance in explaining operation of the display apparatus shown in FIG. 1.

FIG. 2 is a waveform chart of assistance in explaining operation of the display apparatus shown in FIG. 1. In FIG. 2, HST denotes a start pulse inputted to the first stage of the shift register 21 in the horizontal driving circuit 17. As with the HCK pulse and the 2HCK pulse, the start pulse HST is supplied from the clock generating circuit 18. The shift register 21 operates in response to the first clock signals HCK and HCKX. The shift register 21 sequentially transfers HST and thereby generates the shift pulses A, B, C, and D. As shown in FIG. 2, the shift pulses A to D have a pulse width equal to the cycle of the HCK pulse, and are sequentially outputted in synchronism with rising edges and falling edges of the HCK pulse. On the other hand, the second clock signals 2HCK1, 2HCK2, 2HCK3, and 2HCK4 have twice the cycle of the first clock signals HCK and HCKX, and have a pulse width equal to one cycle of the HCK pulse. The second clock signals 2HCK1, 2HCK2, 2HCK3, and 2HCK4 are sequentially shifted in phase by 90 degrees. The first extracting switch extracts the second clock signal 2HCK1 in response to the shift pulse A, and thereby forms the corresponding sampling pulse A'. In other words, a rising edge of the sampling pulse A' is determined by a rising edge of the shift pulse A, and a falling edge of the sampling pulse A' is defined by a falling edge of the second clock signal 2HCK1. Hence, a pulse width W of the sampling pulse A' can be adjusted by a phase relation between the second clock signal 2HCK1 and the shift pulse A. As described above, the shift pulse A is in synchronism with the first clock signals HCK and HCKX. Therefore, by adjusting the phase of the 2HCK pulse with respect to the HCK pulse, the width W of the sampling pulse can be set optimally. Similarly, a rising edge of the sampling pulse B' is determined by a rising edge of the shift pulse B, and a falling edge of the sampling pulse B' is determined by a falling edge of the second clock signal 2HCK2. A rising edge and a falling edge of the subsequent sampling pulses C' and D' are determined in a similar manner.

As shown in FIG. 2, the sampling pulses A' and B' supplied to the sampling switches adjacent to each other overlap each other. Similarly, the sampling pulses B' and C' overlap each other, and the sampling pulses C' and D' overlap each other. Thus, so-called divided sample and hold is performed by supplying the sampling pulses in a state of overlapping each other to adjacent sampling switches and sampling the video signals from the separate video lines. This divided sample and hold driving makes it possible to prevent a vertical streak defect appearing when specific patterns are displayed. The vertical streak defect for example appears when a checkered pattern is displayed at a time of line reversal driving and when a pattern of one-dot horizontal lines is displayed at a time of dot line reversal driving.

The sampling switches connected to the same video line are sequentially supplied with sampling pulses in a perfectly non-overlapping state. For example, the sampling pulses A' and C' are in a perfectly non-overlapping state, and the sampling pulses B' and D' are also in a perfectly non-overlapping state. Thus, by supplying perfectly non-overlapping sampling pulses to the sampling switches connected to the same video line, it is possible to prevent display defects such as a vertical streak and a ghost specific to the active matrix display apparatus of a dot-sequential driving type. As shown by a dotted arrow, for example, at the falling edge of the sampling pulse A', sampling of the video signal Video 1 is completed, and potential of the corresponding signal line is held. As shown by a solid arrow, the sampling pulse C' thereafter rises, and sampling of the video signal Video 1 from the same video line is started. At this time, signal charge/discharge sharply lowers potential of the video signal Video 1.on the video line, thus causing so-called charge/discharge noise. At this time, the previous sampling pulse A' has already fallen, and therefore there is no fear of the charge/discharge noise being sampled. It is thereby possible to prevent occurrence of a vertical streak and increase a ghost margin.

Figure 3:
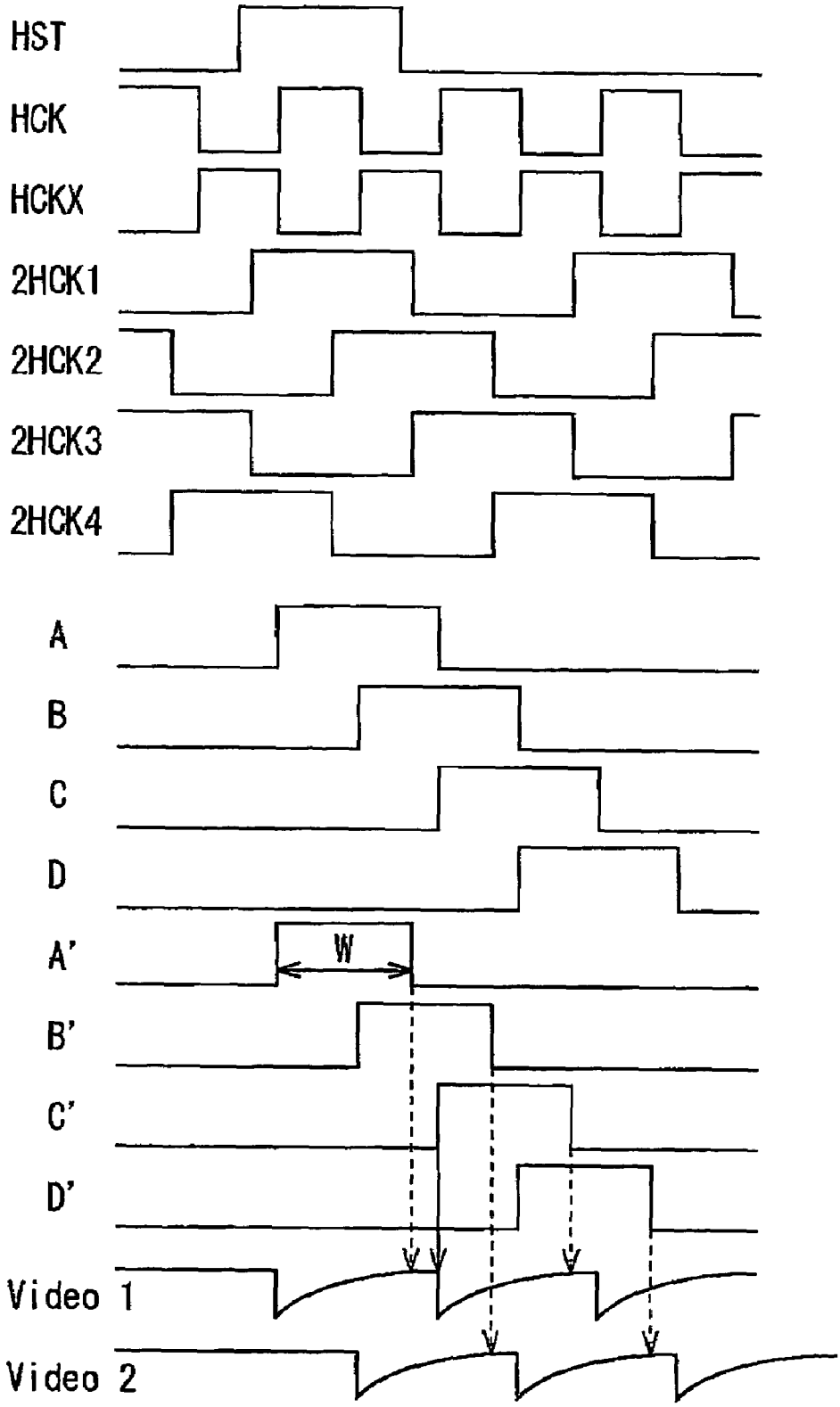
FIG. 3 is similarly a waveform chart of assistance in explaining operation of the display apparatus shown in FIG. 1.

FIG. 3 shows a state in which the phase of the 2HCK pulse with respect to the HCK pulse is shifted from that in the timing chart of FIG. 2. In the example of FIG. 3, the 2HCK pulse is delayed as compared with the example of FIG. 2. As described above, the width W of a sampling pulse is determined by a rising edge of the shift pulse and a falling edge of the 2HCK pulse. The width W of the sampling pulse A', for example, is determined by a rising edge of the shift pulse A and a falling edge of the 2HCK1 pulse. Since the 2HCK pulse in the example of FIG. 3 is delayed as compared with the example of FIG. 2, the width of the sampling pulses is increased. Thus, by changing the phase of the 2HCK pulse with respect to the HCK pulse, the sampling pulse width W after extraction can be varied. In particular, sampling pulses A', B', C', D' . . . having a pulse width W substantially equal to the cycle of the HCK pulse can be obtained in the example of FIG. 3. It is thereby possible to select the best sampling pulse width in consideration of a vertical streak level and the ghost margin.

Figure 4:
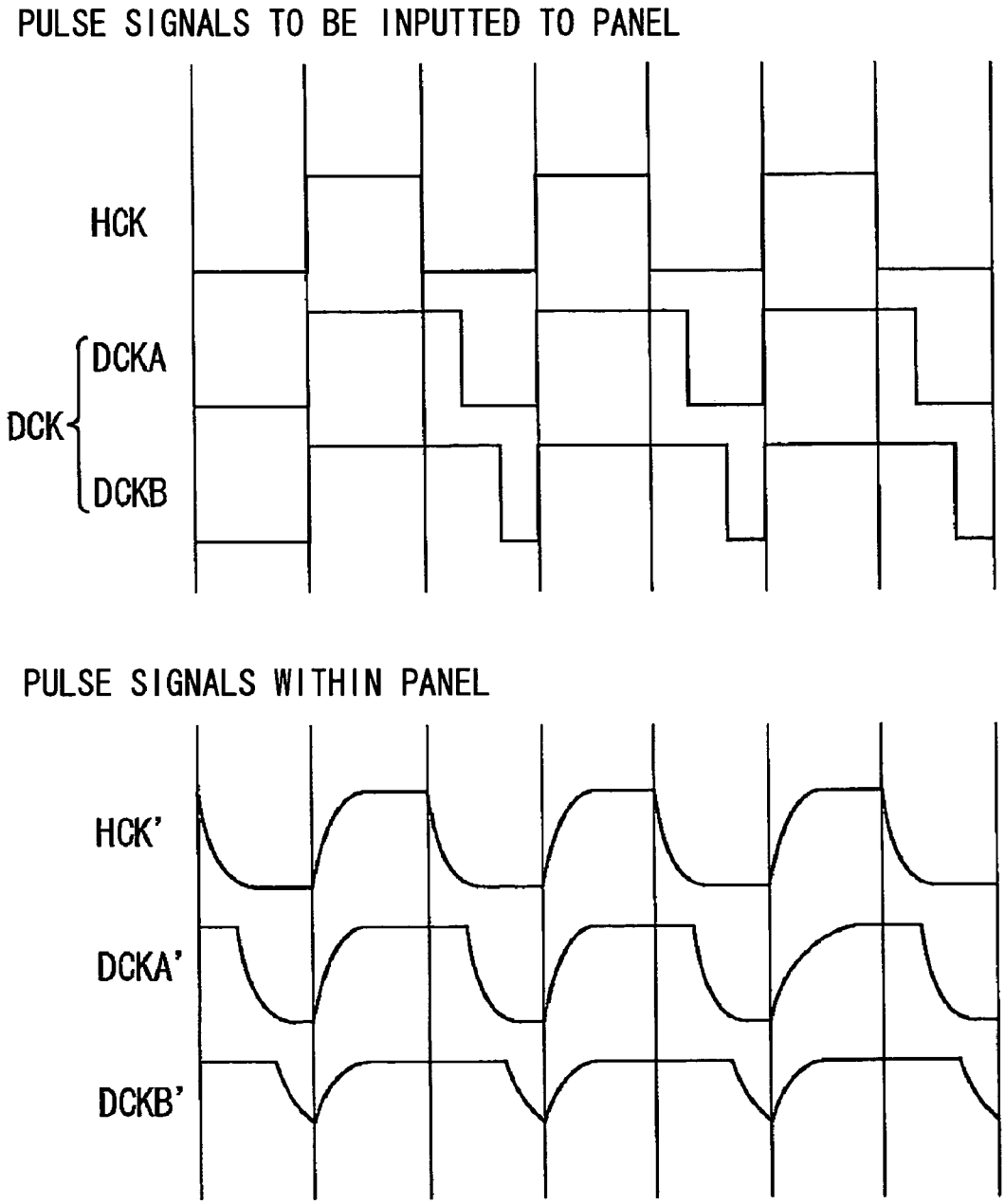
FIG. 4 is a waveform chart of assistance in explaining operation of a display apparatus for reference.

FIG. 4 is a timing chart illustrating another method for realizing sequential perfect non-overlap sampling in signal lines connected to the same video line in divided sample and hold driving. In the other method, the external clock generating circuit supplies a DCK pulse for extraction in addition to the HCK pulse serving as a basis for the operation of the horizontal driving circuit. Unlike the 2HCK pulse used in the present invention, the DCK pulse used in the other method has the same cycle as that of the HCK pulse and a greater pulse width than that of the HCK pulse. The clock generating circuit can variably adjust the width of the DCK pulse. In the example shown in FIG. 4, a DCKB pulse is longer than a DCKA pulse. In the other method, the DCK pulse is extracted in response to a shift pulse outputted from the horizontal driving circuit operating on the basis of the HCK pulse, whereby a desired sampling pulse is generated. This method optimizes the width of the sampling pulse by adjusting the width of the DCK pulse. The other method is characterized in that while the DCK pulse has the same cycle as the HCK pulse, the DCK pulse has a greater pulse width than the HCK pulse. Since a pulse transmission path generally has a resistance and a parasitic capacitance, however, rising edges and falling edges of the HCK pulse and the DCK pulse are rounded within the panel, as shown in FIG. 4. When the pulse width is increased as in the case of the DCKB pulse, the pulse does not completely fall within the panel, as indicated by DCKB', so that normal clock drive operation is not performed. Therefore, the width of the DCK pulse needs to be at least shorter than the cycle of the HCK pulse. As a result, a variable range of the width of the generated sampling pulse is narrowed. In order to obtain an optimum sampling pulse width in consideration of the vertical streak in the above-mentioned specific patterns, the vertical streak specific to dot-sequential driving, or the ghost, it is desirable to be able to variably set the sampling pulse width without specific limitations by adjusting the phase of the HCK pulse and the 2HCK pulse as in the present invention.

Figure 5:
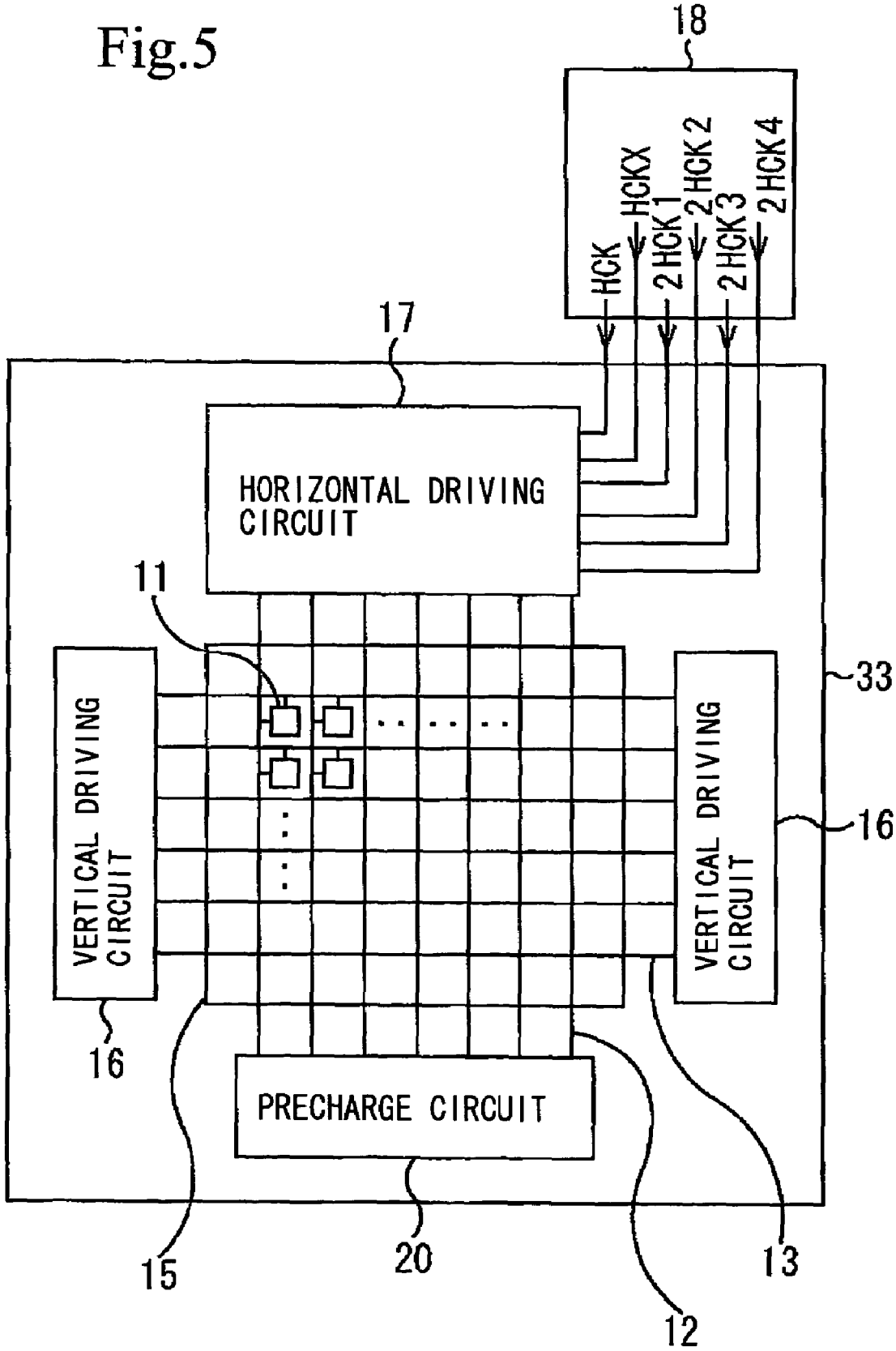
FIG. 5 is a block diagram showing an example of general configuration of the display apparatus shown in FIG. 1.

FIG. 5 is a schematic block diagram of a general configuration of the display apparatus according to the present invention. As shown in FIG. 5, the display apparatus is formed by a panel 33 having a pixel array unit 15, the vertical driving circuit 16, the horizontal driving circuit 17 and the like formed therein in an integrated manner. The pixel array unit 15 comprises the gate lines 13 in the form of rows, the signal lines 12 in the form of columns, and the pixels 11 arranged in the form of a matrix at intersections of the gate lines 13 and the signal lines 12. The vertical driving circuit 16 is divided into circuits disposed on the left and right sides, which circuits are connected to both ends of the gate lines 13 to sequentially select rows of the pixels 11. The horizontal driving circuit 17 is connected to the signal lines 12. The horizontal driving circuit 17 operates on the basis of a clock signal having a predetermined cycle to sequentially write a video signal to pixels 11 of a selected row. Incidentally, a precharge circuit 20 is also connected to each of the signal lines 12. The precharge circuit 20 precharges each of the signal lines prior to the writing of the video signal, and thereby improves picture quality. The display apparatus further includes the clock generating circuit 18. The clock generating circuit 18 generates the first clock signals HCK and HCKX serving as the basis for the operation of the horizontal driving circuit 17, and also generates the second clock signals 2HCK1, 2HCK2, 2HCK3, and 2HCK4 having twice the cycle of the first clock signals HCK and HCKX and having twice the pulse width of the first clock signals HCK and HCKX. HCKX denotes an inverted signal of HCK. The second clock signals 2HCK1, 2HCK2, 2HCK3, and 2HCK4 are shifted in phase with respect to each other by 90 degrees.

The horizontal driving circuit 17 sequentially outputs shift pulses on the basis of the HCK pulse. The horizontal driving circuit 17 further generates sampling pulses by extracting the 2HCK pulse in response to the shift pulses. Consequently, sampling pulses assigned to adjacent signal lines overlap each other, whereas sampling pulses assigned to signal lines connected to the same video line are in a perfectly non-overlapping state.

Figure 6:
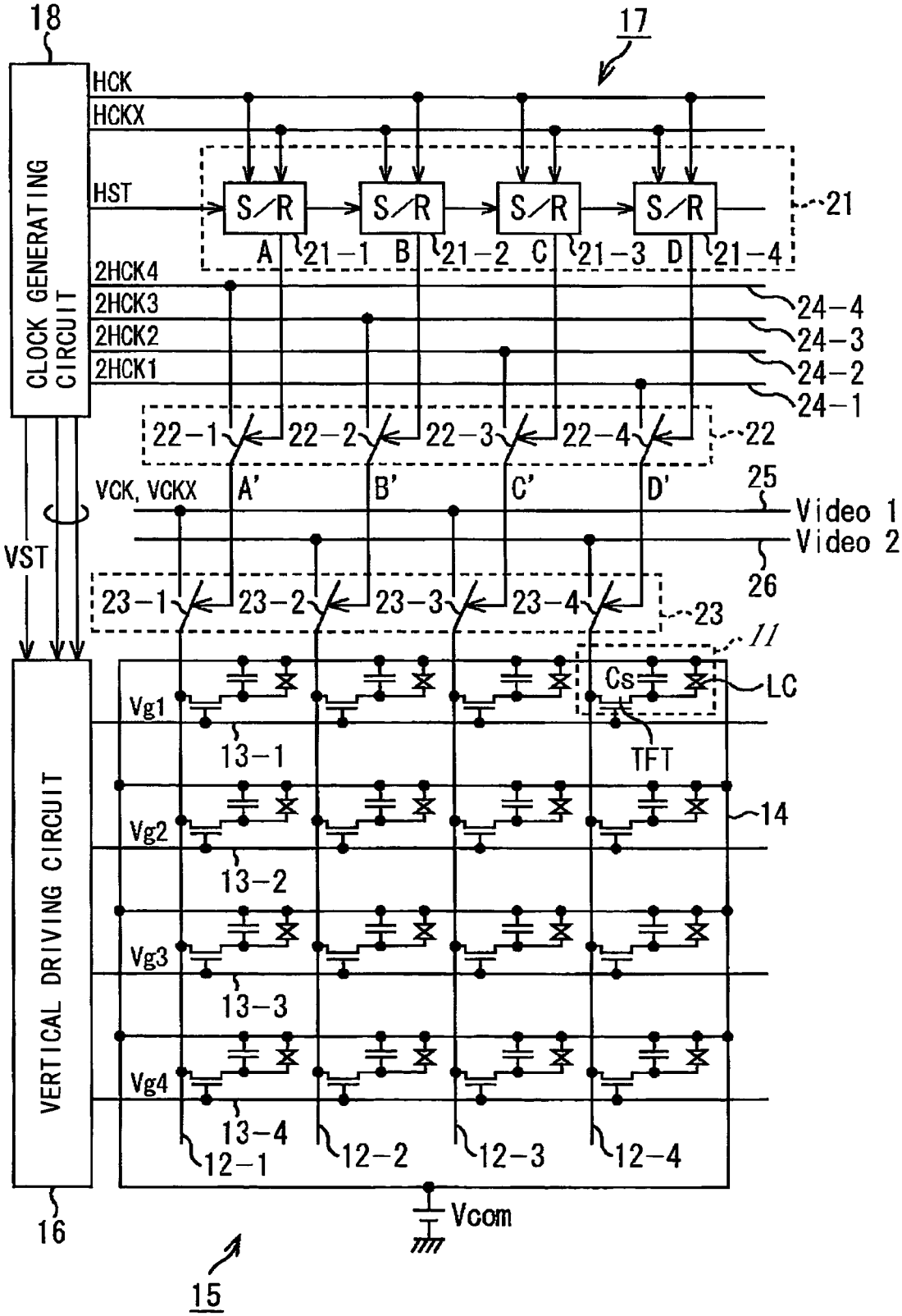
FIG. 6 is a circuit diagram showing an example of configuration of an active matrix liquid crystal display apparatus of a dot-sequential driving type according to an embodiment of the present invention.
Figure 7:
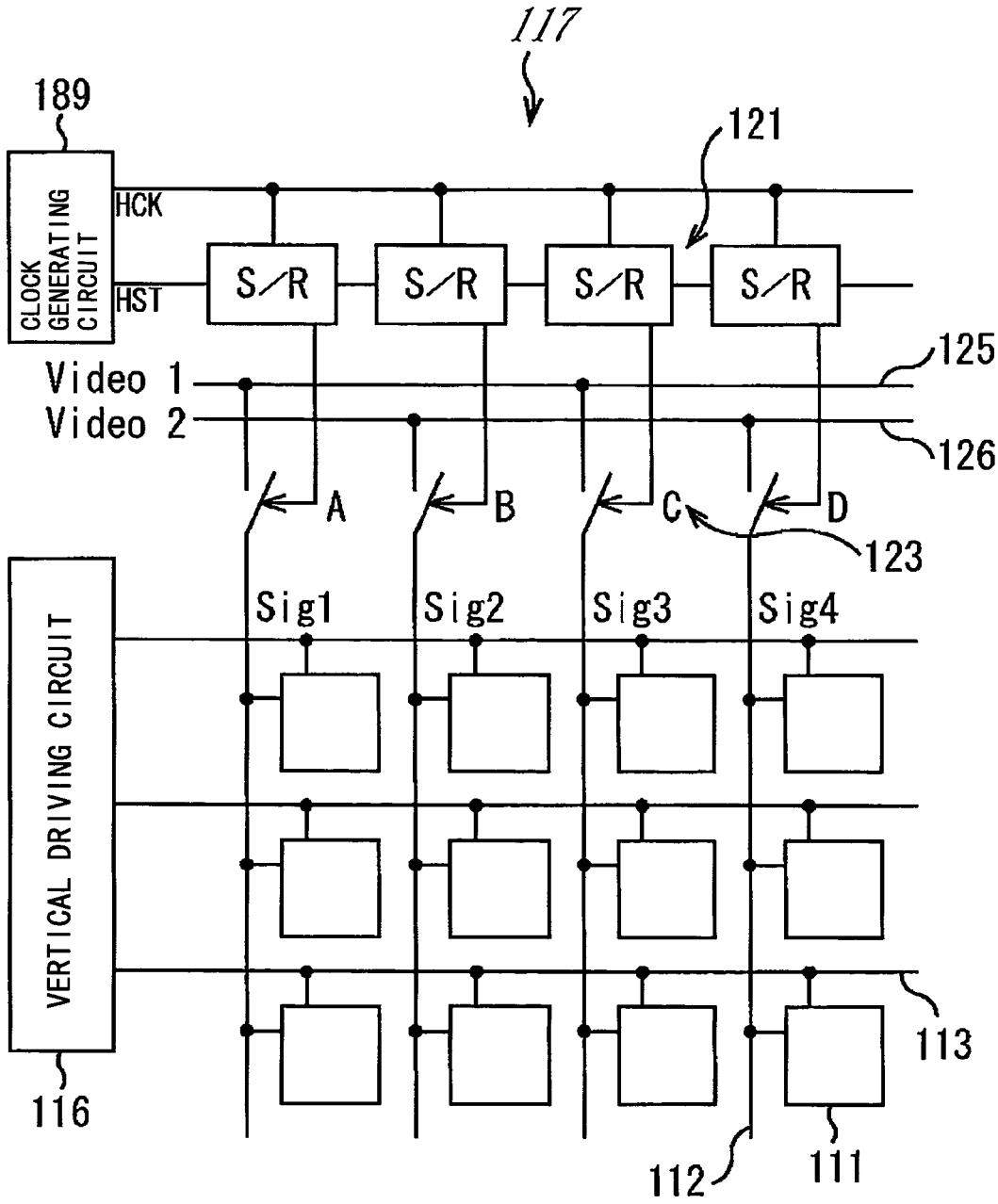
FIG. 7 is a block diagram showing an example of a conventional display apparatus.
Figure 8:
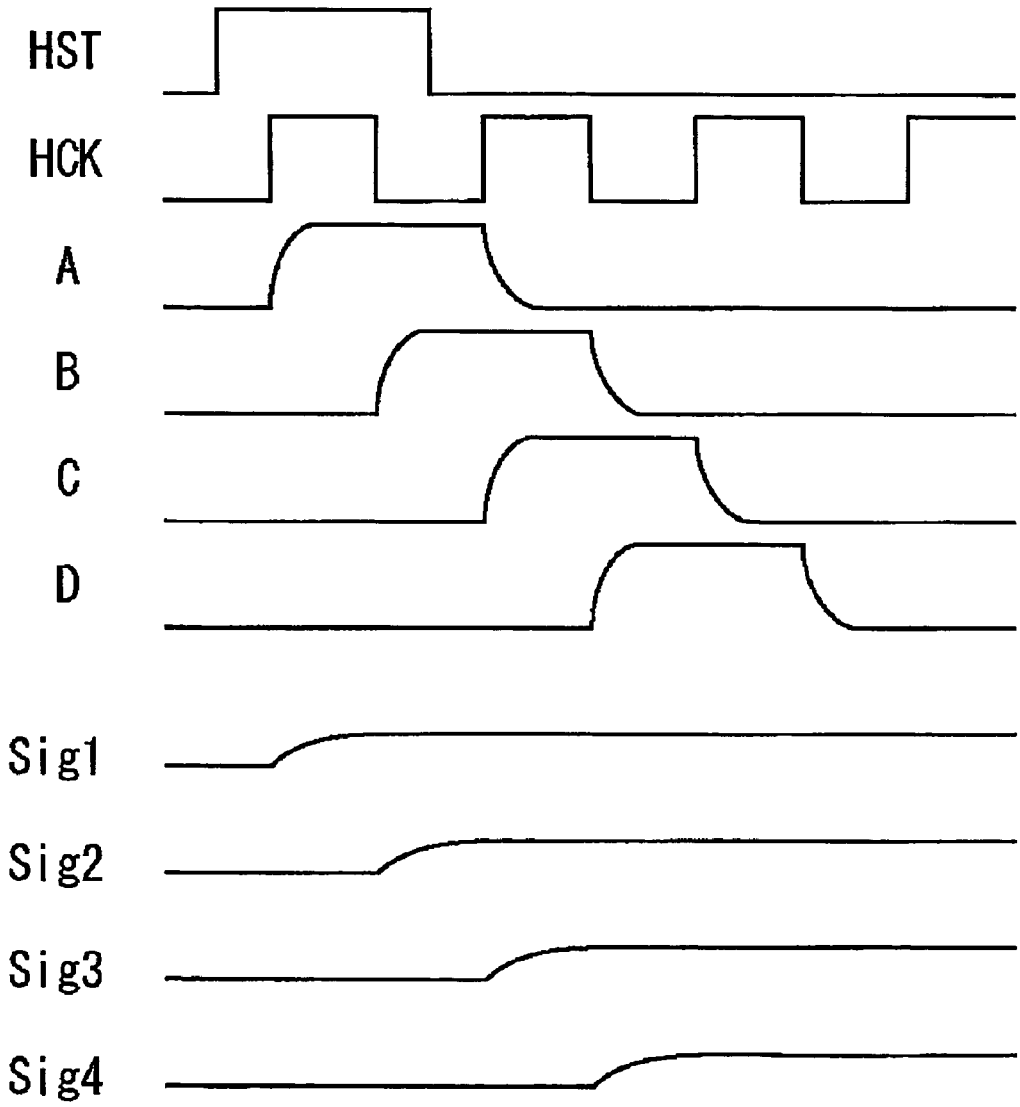
FIG. 8 is a waveform chart of assistance in explaining operation of the conventional display apparatus shown in FIG. 7.
Figure 9:
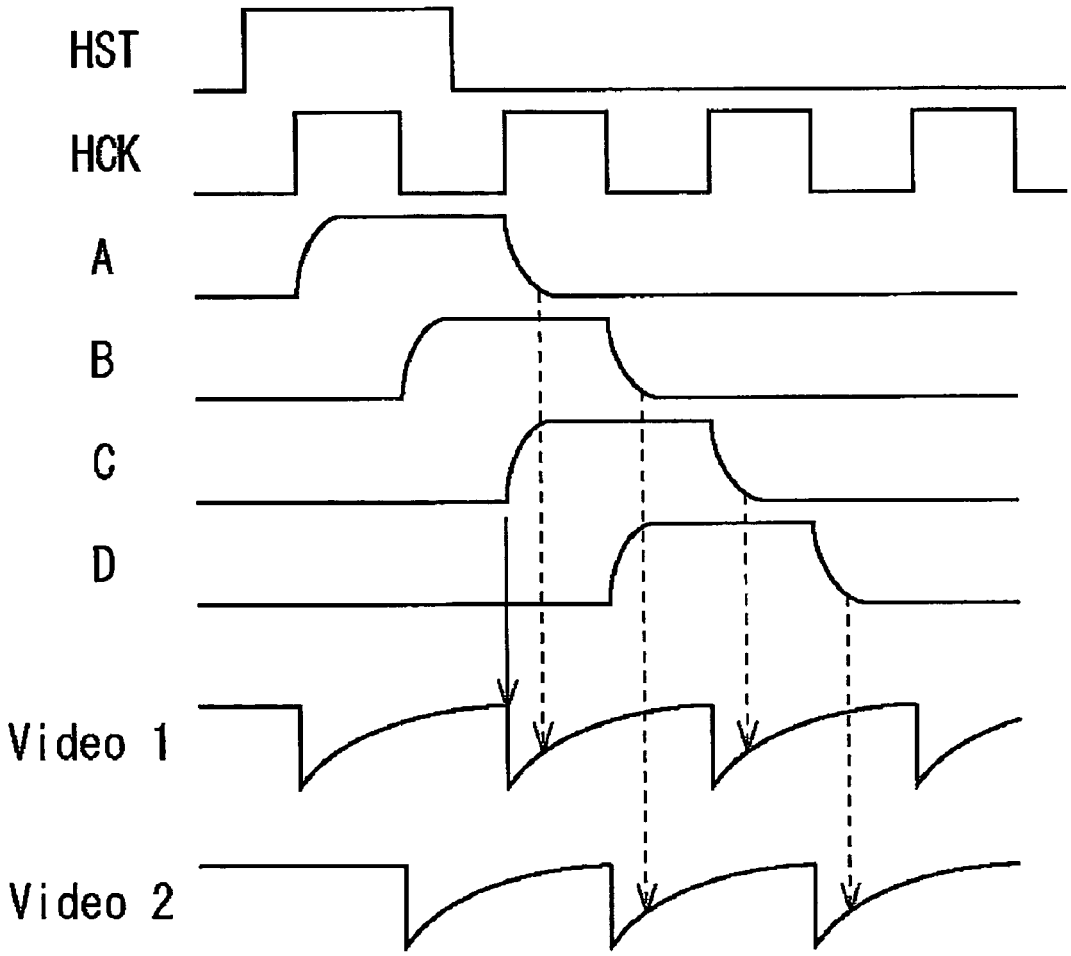
FIG. 9 is a waveform chart of assistance in explaining operation of the conventional display apparatus shown in FIG. 7.

FIG. 6 shows a concrete example of configuration of the display apparatus shown in FIG. 5. FIG. 6 is a circuit diagram showing a configuration of the active matrix liquid crystal display apparatus of the dot-sequential driving type which apparatus uses a liquid crystal cell as a display element (electro-optical element) of a pixel, for example. In this case, for simplicity of the figure, a pixel arrangement of four rows and four columns is taken as an example. The active matrix liquid crystal display apparatus generally uses a thin film transistor (TFT) as a switching element of each pixel.

In FIG. 6, each of the pixels 11 arranged in a form of a matrix in four rows and four columns comprises: a thin film transistor TFT, or a pixel transistor; a liquid crystal cell LC having a pixel electrode connected to a drain electrode of the thin film transistor TFT; and a retaining capacitance Cs having one electrode connected to the drain electrode of the thin film transistor TFT. For each of these pixels 11, signal lines 12-1 to 12-4 are arranged in the respective columns along a pixel arrangement direction of the columns, while gate lines 13-1 to 13-4 are arranged in the respective rows along a pixel arrangement direction of the rows.

A source electrode (or drain electrode) of the thin film transistor TFT in each of the pixels 11 is connected to a corresponding one of the signal lines 12-1 to 12-4. A gate electrode of the thin film transistor TFT is connected to one of the gate lines 13-1 to 13-4. A counter electrode of the liquid crystal cell LC and another electrode of the retaining capacitance Cs are connected to a Cs line 14 common among the pixels. The Cs line 14 is supplied with a predetermined direct-current voltage as a common voltage Vcom.

Thus, a pixel array unit 15 is formed in which the pixels 11 are arranged in the form of a matrix, and for the pixels 11, the signal lines 12-1 to 12-4 are arranged in the respective columns and the gate lines 13-1 to 13-4 are arranged in the respective rows. One end of each of the gate lines 13-1 to 13-4 in the pixel array unit 15 is connected to an output terminal for each stage of a vertical driving circuit 16 disposed on the left side of the pixel array unit 15, for example.

The vertical driving circuit 16 scans in a vertical direction (row direction) in each field period to sequentially select the pixels 11 connected to the gate lines 13-1 to 13-4 in units of a row. Specifically, when the vertical driving circuit 16 supplies a scanning pulse Vg1 to the gate line 13-1, a pixel in the first row in each of the columns is selected. When the vertical driving circuit 16 supplies a scanning pulse Vg2 to the gate line 13-2, a pixel in the second row in each of the columns is selected. Similarly, scanning pulses Vg3 and Vg4 are thereafter sequentially supplied to the gate lines 13-3 and 13-4.

A horizontal driving circuit 17 is disposed on an upper side of the pixel array unit 15, for example. Also, an external clock generating circuit (timing generator) 18 for supplying various clock signals to the vertical driving circuit 16 and the horizontal driving circuit 17 is provided. The clock generating circuit 18 generates a vertical start pulse VST for giving an instruction to start vertical scanning, vertical clocks VCK and VCKX opposite to each other in phase which clocks serve as reference for vertical scanning, a horizontal start pulse HST for giving an instruction to start horizontal scanning, and horizontal clocks HCK and HCKX opposite to each other in phase which clocks serve as reference for horizontal scanning. The clock generating circuit 18 further generates pulses 2HCK1, 2HCK2, 2HCK3, and 2HCK4 for clock driving. These 2HCK pulses have twice the cycle of the HCK pulse. The pulses 2HCK1, 2HCK2, 2HCK3, and 2HCK4 are shifted in phase with respect to each other by 90 degrees.

The horizontal driving circuit 17 is provided to sequentially sample video signals Video 1 and Video 2 inputted via two divided video lines 25 and 26 in each H (H is a horizontal scanning period) and write the video signals to each of pixels 11 selected in a unit of a row by the vertical driving circuit 16. In this example, a clock driving system is used. The horizontal driving circuit 17 includes a shift register 21, a clock extracting switch group 22, and a sampling switch group 23.

The shift register 21 comprises four shift stages (S/R stages) 21-1 to 21-4 corresponding to the pixel columns (four columns in this example) of the pixel array unit 15. When the horizontal start pulse HST is supplied to the shift register 21, the shift register 21 performs shift operation in synchronism with the horizontal clocks HCK and HCKX opposite to each other in phase. Thereby, the shift stages 21-1 to 21-4 of the shift register 21 sequentially output shift pulses A to D having a pulse width equal to a cycle of the horizontal clocks HCK and HCKX.

The clock extracting switch group 22 comprises four switches 22-1 to 22-4 corresponding to the pixel columns of the pixel array unit 15. The switches 22-1 to 22-4 are connected at one terminal thereof to clock lines 24-1 to 24-4 that transmit the clocks 2HCK1 to 2HCK4 from the clock generating circuit 18. Specifically, one terminal of the switch 22-1 is connected to the clock line 24-4; one terminal of the switch 22-2 is connected to the clock line 24-3; one terminal of the switch 22-3 is connected to the clock line 24-2; and one terminal of the switch 22-4 is connected to the clock line 24-1.

The switches 22-1 to 22-4 of the clock extracting switch group 22 are supplied with the shift pulses A to D sequentially outputted from the shift stages 21-1 to 21-4 of the shift register 21. When supplied with the shift pulses A to D from the shift stages 21-1 to 21-4 of the shift register 21, the switches 22-1 to 22-4 of the clock extracting switch group 22 are sequentially turned on in response to the shift pulses A to D to sequentially extract the clocks 2HCK1 to 2HCK4 that are shifted in phase by 90° with respect to each other.

The sampling switch group 23 comprises four switches 23-1 to 23-4 corresponding to the pixel columns of the pixel array unit 15. The switches 23-1 to 23-4 are alternately connected at one terminal thereof to the video lines 25 and 26 for inputting the video signals Video 1 and Video 2. The clocks 2HCK1 to 2HCK4 extracted by the switches 22-1 to 22-4 of the clock extracting switch group 22 are supplied as sampling pulses A' to D' to the switches 23-1 to 23-4 of the sampling switch group 23.

When supplied with the sampling pulses A' to D' from the switches 22-1 to 22-4 of the clock extracting switch group 22, the switches 23-1 to 23-4 of the sampling switch group 23 are sequentially turned on in response to the sampling pulses A' to D' to sequentially sample the video signals Video 1 and Video 2 inputted through the video lines 25 and 26. The switches 23-1 to 23-4 of the sampling switch group 23 then supply the sampled video signals Video 1 and Video 2 to the signal lines 12-1 to 12-4 of the pixel array unit 15.

The thus formed horizontal driving circuit 17 sequentially extracts the pulses 2HCK1, 2HCK2, 2HCK3, and 2HCK4 for clock driving in synchronism with the shift pulses A to D and uses the pulses 2HCK1, 2HCK2, 2HCK3, and 2HCK4 as the sampling pulses A' to D', rather than using the shift pulses A to D sequentially outputted from the shift register 21 as they are as the sampling pulses. Thereby, variations of the sampling pulses A' to D' can be suppressed. As a result, a ghost caused by variations of the sampling pulses A' to D' can be eliminated.

As described above, according to the present invention, by clock-driving the 2HCK pulse having twice the cycle of the HCK pulse and having twice the pulse width of the HCK pulse, perfect non-overlap sampling compatible with divided sample and hold driving is realized, whereby occurrence of a vertical streak can be prevented and the ghost margin can be increased. By generating the 2HCK pulse outside the panel and changing the phase of the 2HCK pulse with respect to the HCK pulse, in particular, optimum setting of the sampling pulse width can be made freely.

The invention claimed is:

1. A display apparatus comprising:

a panel comprising gate lines in a form of rows, signal lines in a form of columns, pixels arranged in a form of a matrix at intersections of the gate lines and the signal lines, and n (n is an integer of 2 or more) video lines for supplying video signals separated in n systems in predetermined phase relation;

a vertical driving circuit connected to each of the gate lines, for sequentially selecting rows of the pixels;

a sampling switch group disposed so as to correspond to each of the signal lines, and connected between each of said n video lines and the signal lines with n signal lines as a unit;

a horizontal driving circuit operating on the basis of a clock signal having a predetermined cycle, for sequentially generating sampling pulses of which sampling pulses supplied to switches connected to an identical video line among switches of said sampling switch group do not overlap each other and sampling pulses supplied to adjacent switches overlap each other, and sequentially driving the switches, whereby the video signals are sequentially written to pixels of a selected row; and a clock generating circuit for generating a first clock signal serving as a basis for operation of said horizontal driving circuit, and also generating a second clock signal having twice a cycle of the first clock signal and twice a pulse width of the first clock signal;

wherein said horizontal driving circuit comprises:

a shift register for performing shift operation in synchronism with said first clock signal and sequentially outputting shift pulses from respective shift stages; and an extracting switch group for extracting said second clock signal in response to said shift pulses sequentially outputted from said shift register, and sequentially generating said sampling pulses.

2. A display apparatus as claimed in claim 1, wherein said clock generating circuit variably adjusts a phase of said second clock signal with respect to said first clock signal.

3. A display apparatus as claimed in claim 2, wherein said clock generating circuit variably adjusts the phase of said second clock signal with respect to said first clock signal, and thus optimizes a width of said sampling pulses.

* * * * *